United States Patent [19]

Giacopelli

[11] 4,014,776

[45] Mar. 29, 1977

[54] ELECTROLYTIC APPARATUS

[75] Inventor: Umberto Giacopelli, Rosignano-Solvay Leghorn, Italy

[73] Assignee: Solvay & Cie, Belgium

[22] Filed: July 1, 1974

[21] Appl. No.: 484,881

[30] Foreign Application Priority Data

July 11, 1973 Belgium ..... 133339

[52] U.S. Cl. ..... 204/257; 204/258; 204/267; 204/270; 204/286

[51] Int. Cl.[2] ..... C25B 1/24; C25B 9/02

[58] Field of Search ..... 204/253, 257, 258, 267, 204/269, 270, 286

[56] References Cited

UNITED STATES PATENTS

| | | | |
|---|---|---|---|
| 1,296,046 | 3/1919 | Charbonneaux | 204/267 |
| 1,753,123 | 4/1930 | Krebs | 204/253 |
| 2,920,028 | 1/1960 | Forbes | 204/258 X |
| 3,342,717 | 9/1967 | Leduc | 204/266 X |
| 3,755,105 | 8/1973 | Messner | 204/95 |
| 3,759,815 | 9/1973 | Larsson | 204/268 |
| 3,761,384 | 9/1973 | Ruthel et al. | 204/288 |

FOREIGN PATENTS OR APPLICATIONS

| | | | |
|---|---|---|---|
| 868,516 | 4/1971 | Canada | 204/266 |

*Primary Examiner*—Arthur C. Prescott
*Attorney, Agent, or Firm*—Robert E. Burns; Emmanuel J. Lobato; Bruce L. Adams

[57] ABSTRACT

Vertically stacked electrolytic cells are fluid-tightly separated from one another by separator and collector means generally horizontally disposed between superposed cells. Each of the cells has side walls and generally vertical and parallel spaced cathodes supported by the side walls, with generally vertical and parallel anode plates alternating with the cathodes. A current collector between the superposed cells is connected to lower ends of anode plates in the upper cell and to upper ends of anode plates in the lower cell so as to feed electric current to anode plates of both cells.

16 Claims, 7 Drawing Figures

ELECTROLYTIC APPARATUS

Figure 1:
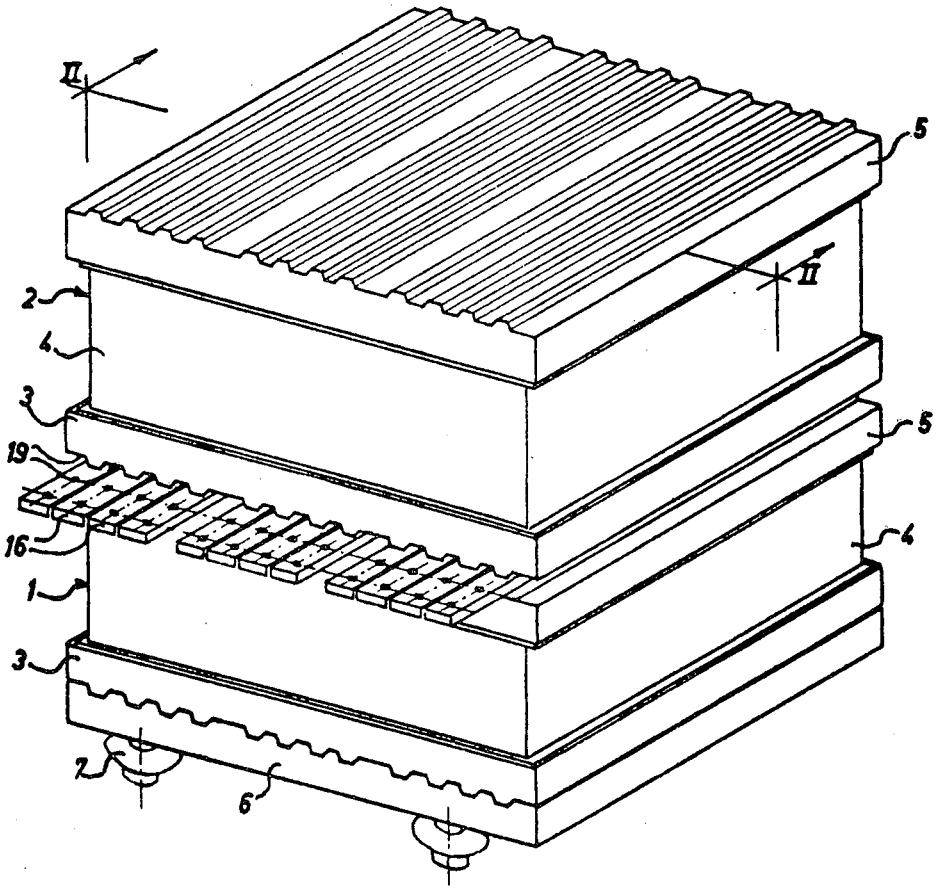

The present invention relates to electrolytic apparatus comprising at least two electrolytic cells in which substantially vertical and parallel anode plates alternate with substantially vertical and parallel cathodes.

Cells of this type are generally used for the electrolysis of aqueous solutions of alkali metal halides, particularly for the production of chlorine, sodium hypochlorite or sodium chlorate, starting from a sodium chloride brine.

In order to ensure high productivity, while limiting the use of floor space, it is known to use electrolytic apparatus equipped with bipolar electrodes. This known electrolytic apparatus is made up of a juxtaposition of individual cells which are separated successively from each other by partitions which carry anodes on one face and cathode on their other face.

In Belgian Pat. No. 791042 there is proposed for example an electrolyser with bipolar electrodes, wherein the individual cells are placed one above the other. This known electrolyser has the advantage of occupying little floor space.

One of the principle disadvantages of bipolar electrolysers lies in the fact that correct operation of the electrolyser depends on correct operation of each of the individual cells. When a fault occurs in any one of the individual cells, this fault immediately affects the normal running of the whole of the electrolyser, so that when this occurs it is necessary immediately to stop the electrolyser and to repair the defective cell. This disadvantage of bipolar electrolysers is particularly noticeable in the case of diaphragm-cell electrolysers for the manufacture of chlorine. In order to prevent too frequent stoppages of the electrolyser, due to wrinkling of the diaphragms, these electrolysers require careful mounting on the diaphragms as well as strict purification of the feed brine, and these requirements react unfavourably upon the operating costs.

Bipolar electrolysers have the further disadvantage that an appreciable fraction of the impressed current is shunted in the form of parasitic currents by way of the feed pipes bringing electrolyte into the individual cells as well as by way of the collecting pipes through which the electrolytic products are removed.

In order to avoid the disadvantages of bipolar electrolysers it is also known to place several monopolar cells side by side and to connect them to each other in series, for example in the manner described in U.S. Pat. No. 3,432,422. The electrolysers constructed in this way have the disadvantage of requiring considerable floor space. The electrical connections linking the cells together are furthermore the seat of large losses of energy, because of their resistive effect. These electrolysers also have the disadvantage already mentioned of the bipolar electrolysers, with regard to the inevitable appearance of parasitic currents shunted by way of the electrolyte feed pipe and the collecting pipes for removal of the product of electrolysis.

In order to avoid these disadvantages of the known electrolysers, attempts have been made to increase the productivity of single cells, so as to reduce the number of individual cells making up the electrolyser. It has for example been proposed to increase the height of their electrodes.

It has however been found with this arrangement that when the anodes are too high they heat up to an exaggerated extent and become the source of a thermal gradient which is likely to cause their deformation. Furthermore, in the case of diaphragm cells for the manufacture of chlorine, electrodes that are too tall impede the liberation of chlorine at the anodes and its evacuation from the anode-cathode spaces.

It has also been proposed to increase the number of electrodes in the unit cells. This solution is however limited by considerations of engineering and economics. It also has the disadvantage of increasing the floor space required by the electrolyser.

The present invention overcomes these disadvantages of known electrolysers.

According to the present invention therefore, there is provided electrolytic apparatus comprising at least two electrolytic cells, each of which contains substantially vertical and parallel anode plates that alternate with cathodes connected to a wall of the cell, and each of which is in communication with a pipe for feeding in an electrolyte for electrolysis and with pipes for removing products of electrolysis, wherein the said cells are superimposed one upon another and have their anodes connected in parallel to a common current collector.

The apparatus according to the invention has the advantage of high productivity with reduced floor space. It readily incorporates unit cells that have electrodes of small height, thus ensuring high energy efficiency.

In the electrolytic apparatus according to the invention, the pipes for admitting the electrolyte into the unit cells are at the same potential. Consequently they may be connected together to a common electrolyte feed system without fear of causing parasitic electric currents shunted by way of the individual inlet pipes and the common pipe system. The same applies to the pipes for removing each of the products of electrolysis.

The electrolytic apparatus according to the invention has the great advantage that the functioning of any one of the unit cells is not affected by the functioning of the other cells. It is for example possible in the case of damage occurring in one of the individual cells, to stop feeding electrolyte into that cell without in any way interrupting the electrolysis in the other cells of the apparatus. In the case where the apparatus according to the invention is equipped with a large number of individual cells, it is possible to keep the electrolyser in operation until a sufficient number of cells - for example five cells in the case were the electrolyser comprises ten cells - has been put out of action to justify, as a matter of economics, complete stoppage of the electrolyser and repair of the defective cells.

In a preferred embodiment of the electrolytic apparatus according to the invention, the aforesaid current collector extends between the two superimposed cells. This embodiment has the advantage of reducing the electrical resistance of the connections between the anodes and the current collector. It also improves the compactness of the electrolyser.

Figure 2:
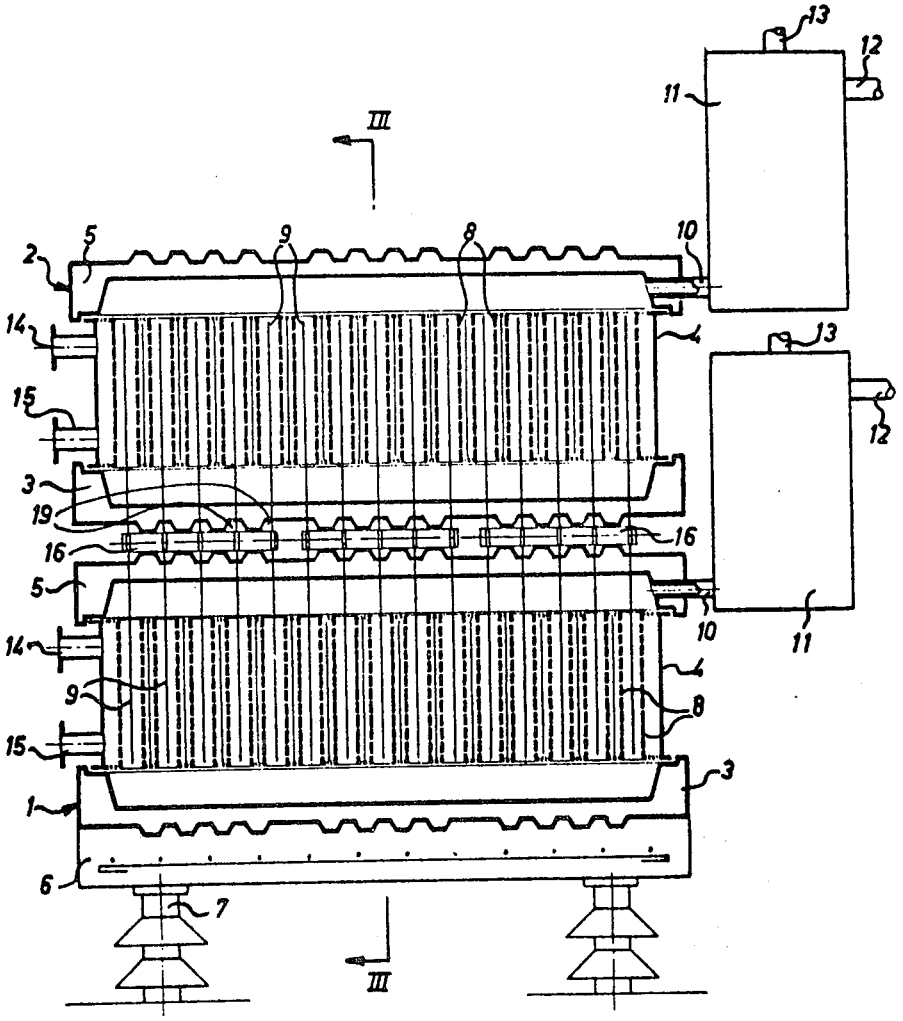
Figure 3:
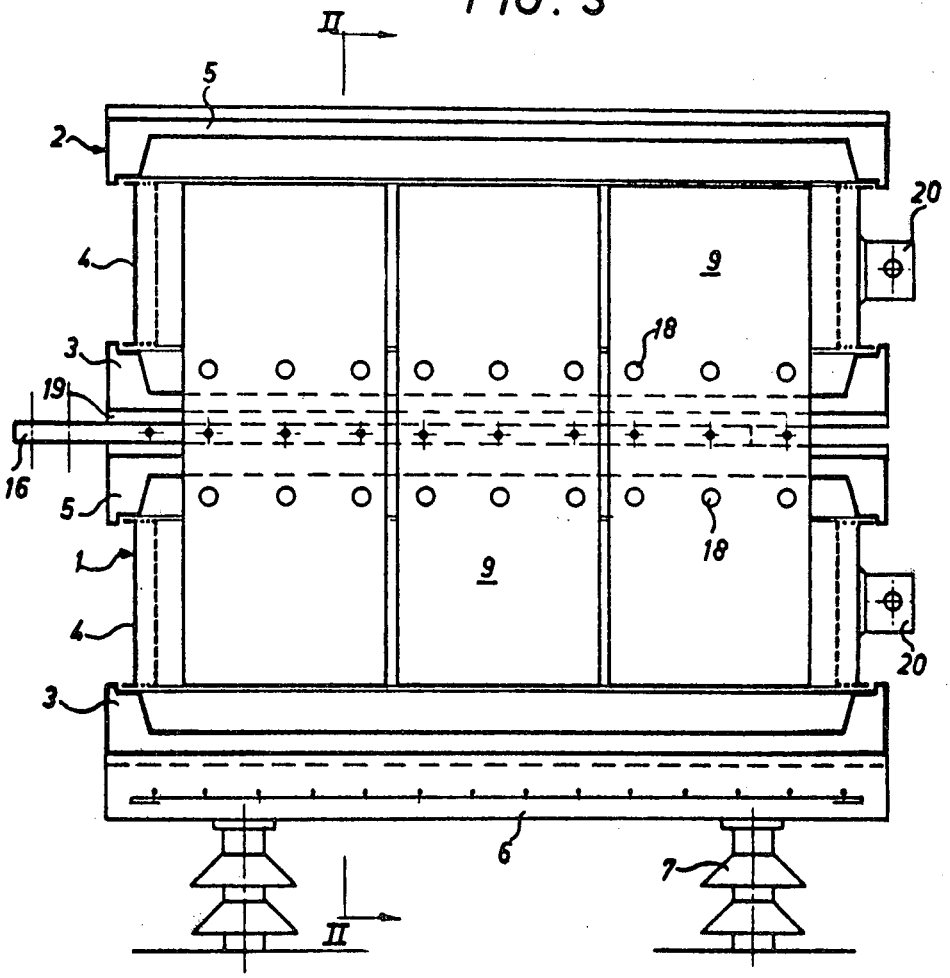
Figure 4:
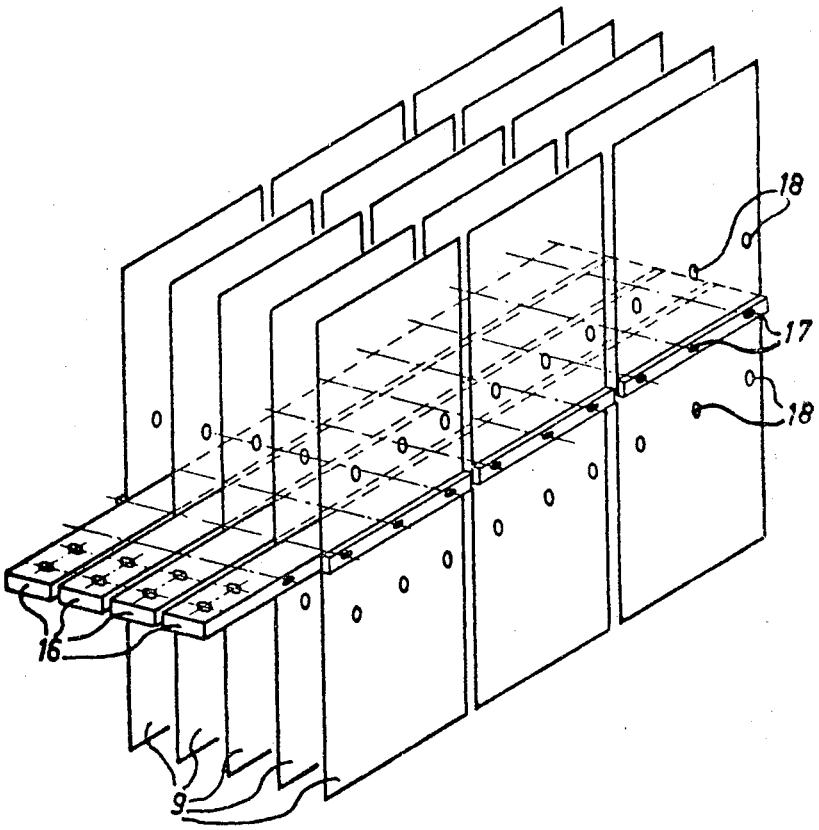

Further features and details of the invention will be apparent from the following discussion of the accompanying drawings, in which like parts are numbered alike;

FIG. 1 shows in perspective one embodiment of the electrolytic apparatus according to the invention, FIG. 2 is a transverse section in the plane II — II of FIG. 1, FIG. 3 is a longitudinal section in the plane III — III of FIG. 2, FIG. 4 shows in perspective the anode assembly of the electrolyser of FIGS. 1 to 3, FIG. 5 shows in vertical transverse section a modification of the electrolyser of FIGS. 1 to 3, FIG. 6 shows in vertical transverse section a modification of the embodiment shown in FIGS. 1 to 3, FIG. 7 shows in transverse vertical section another embodiment of the electrolytic apparatus according to the invention.

In the embodiment shown in FIGS. 1 to 3 the electrolytic apparatus according to the invention comprises two monopolar diaphragm cells 1 and 2. The cells 1 and 2 are superimposed. They each have a base 3 on which rests a cathode casing 4 made of steel, surmounted by a cover 5.

The assembly of two cells is supported by way of the base 3 of the lower cell 1 on a concrete foundation 6, itself supported on insulators 7.

The bases 3 and the covers 5 of the cells 1 and 2 may be made of concrete and covered with a layer of polyester resistant to corrosion by the electrolyte and the products of electrolysis.

The cathode casing 4 of the cells 1 and 2 serves to support an assembly of substantially vertical and parallel cathode pockets 8, which have foraminous walls made of steel connected to two opposing walls of the casing 4 and covered by a diaphragm (not shown).

Anodes 9, which will be discussed in more detail later, extend vertically between the cathode pockets 8.

Each of the cells 1 and 2 is in communication with a pipe 10 passing through its cover and connected to a brine reservoir 11 at the side. This reservoir is in communication on the one hand with a pipe 12 for feeding in brine and on the other hand with a pipe 13 for removing chlorine liberated at the anodes 9.

Each of the cells 1 and 2 is also in communication with a pipe 14 for removing hydrogen produced at the cathodes and with a pipe 15 for removing the caustic liquor from the cathode pockets 8.

In FIG. 4 is shown the anode assembly of the electrolyser of FIGS. 1 to 3. This anode assembly comprises several parallel rows of vertical metallic plates 9 which are secured at the central zone between horizontal metal bars 16, for example by means of bolts and nuts 17. The metal bars 16 are held by clamping between the cover 5 of the lower cell 1 and the base 3 of the upper cells 2, so that the lower part of the plates 9 forms the anodes of the lower cell 1 while the upper part of the plates 9 forms the anodes of the upper cell 2.

The anode plates 9 are preferably made of a film-forming metal, for example titanium, and covered on their two faces by a material which catalyses the discharge of chloride ions, for example a metal or a compound of a metal of the platinum group. The coating may for example comprise a mixture of titanium dioxide and ruthenium oxide.

In order to assist circulation of the anolyte in the cells 1 and 2, the anode plate 9 may be provided with openings 18 in the neighbourhood of the bars 16.

The assembly of bars 16 constitutes a current collector which is common to the anodes of cells 1 and 2. The bars are preferably made of copper or aluminium and are adapted for connecting to a common bus bar (now shown).

In order to reduce the stresses due to thermal expansion of the bars 16 during electrolysis, it is advantageous to divide the assembly of anode plates 9 and bars 16 into several distinct anode groups, for example, in the case of FIG. 2, three groups of five anode plates 9.

Furthermore, in order to limit the heating of the bars 16 during electrolysis, the cover 5 of cell 1 and the base 3 of cell 2 are grooved so as to form ventilation channels 19 facing the bars 16.

Cathode current collectors 20 are fixed, for example by welding, on to the cathode facings 4 of the two cells 1 and 2.

In a modified embodiment (not shown) of the electrolyser of FIGS. 1 to 4, the bars 16 are buried in a mass of concrete which forms both the cover 5 of the cell 1 and the base 3 of the cell 2. This mass of concrete is preferably provided with longitudinal conduits opposite the bars 16 in order to ensure their ventilation.

Figure 5:
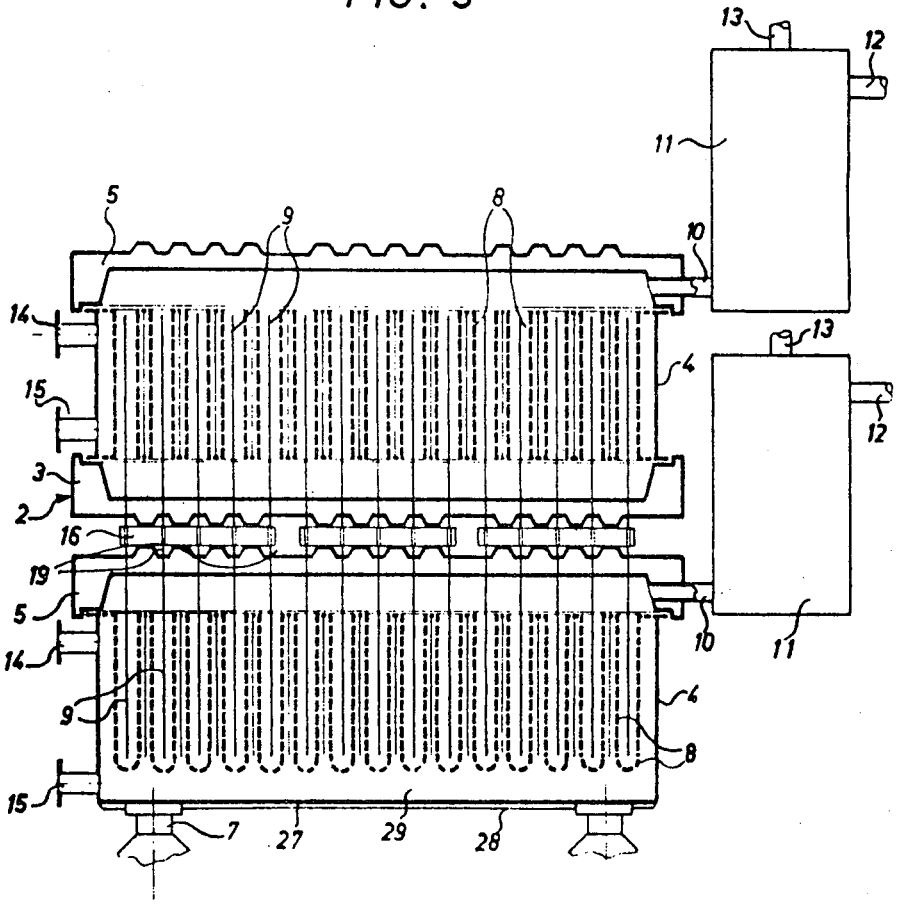

In a modified embodiment, shown in FIG. 5, the base 3 of the lower cell 1 and the foundation 6 are removed. The cathode casing 4 of the lower cell 1 is closed by a base plate 27 made of steel which stands on the insulators 7 and supports the whole of the electrolyser. The cathode pockets 8 are formed by a corrugated steel lattice, covered with a diaphragm and delimiting a lower compartment 29 which is in communication with the cathode pockets 8 and is separated from the anodes 9. Steel girders 28 are welded to the lower face of the plate 27 in order to increase its rigidity.

Figure 6:
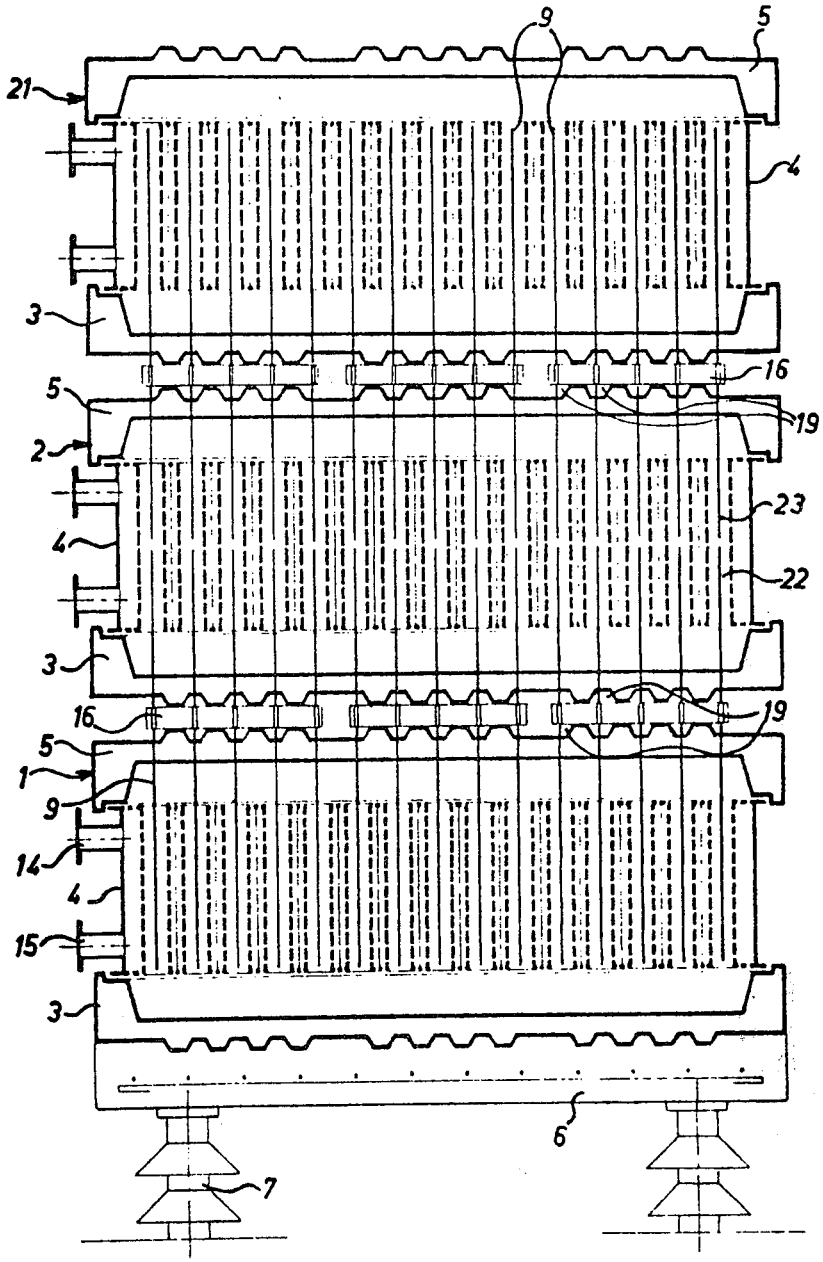

In the embodiment of the electrolytic apparatus according to the invention shown in FIG. 6, the two cells 1 and 2 are surmounted by a third monopolar cell 21 similar to the other two. Between the cover 5 of the intermediate cell 2 and the base 3 of the uppermost cell 21 are fitted the metal bars 16 of a second anode assembly, similar to that shown in FIG. 4.

As seen in FIG. 6, each anode of the intermediate cell 2 comprises two parts 22 and 23 arranged vertically in alignment one above the other. The lower parts 22 are integral with the anode assembly common to cells 1 and 2, while the upper parts 23 are integral with the anode assembly common to cells 2 and 21. The bars 16 of the two anode assemblies are all connected to one bus bar (not shown) so as to form with the latter a common current collector for anodes of the three cells 1, 2 and 21.

In a modified embodiment of the electrolyser of FIG. 6, the base 3 and the foundation 6 of the lower most cell 1 may be removed, the cathode facing 4 of cell 1 then being arranged in the manner described above and as shown in FIG. 5.

Figure 7:
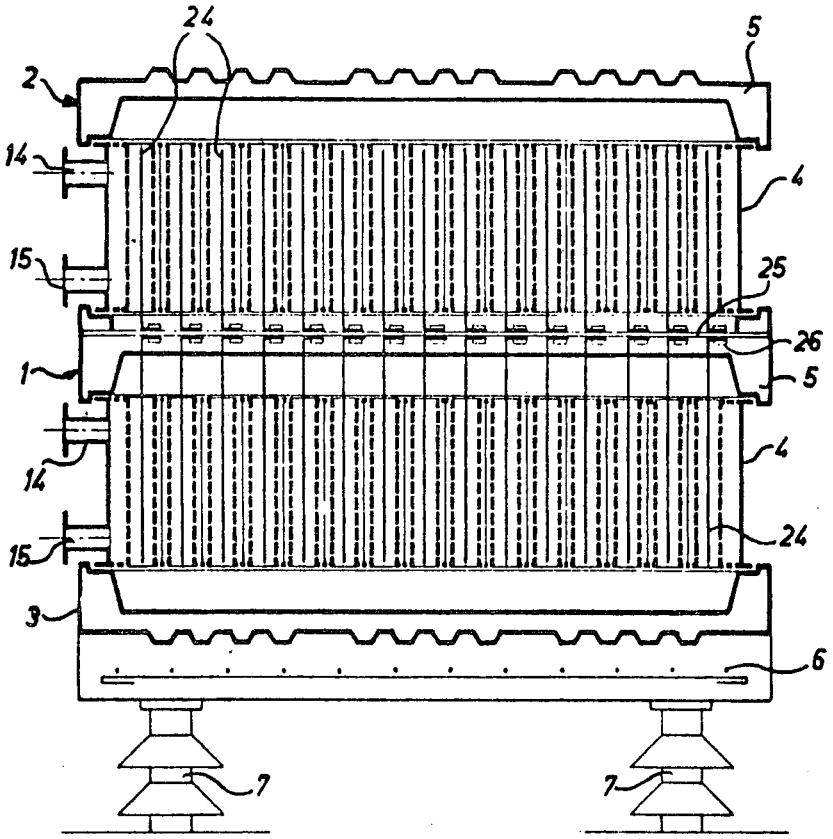

In the embodiment of electrolytic apparatus according to the invention shown in FIG. 7, the anode assembly comprises a series of metal anode plates 24 which are fixed to both the upper side and the lower side of a titanium plate 25 by means of titanium nuts acting on titanium bolts 26 which pass through the plate 25 and the angled ends of the anode plates 24. The plate 25 is fixed onto the concrete cover 5 of the lower cell 1 and constitutes the base of the upper cell 2. The plate 25 also serves as the common current collector for the anodes 24 of the two cells 1 and 2.

In a modification of the electrolyser of FIG. 7, the upper cell 2 is provided with a concrete base 3 like the base shown on the lower cell 1. The titanium plate 25 is then secured to the lower face of the concrete base of the upper cell so as to constitute a cover for the lower cell 1. The concrete cover 5 shown in FIG. 7 of the lower cell 1 can then be dispensed with.

Although in the foregoing detailed description the invention has been applied to apparatus comprising diaphragm cells for the manufacture of chlorine, it may also usefully incorporate other types of cells with vertical electrodes, for example cells for the manufacture of alkali metal hypochlorite or chlorate.

What we claim is:

1. Electrolytic apparatus comprising upper and lower vertically stacked but separate monopolar electrolytic cells, each of said cells comprising side walls, generally vertical and parallel spaced cathodes supported by said side walls and generally vertical and parallel anode plates alternating with said cathodes, separator and collector means disposed generally horizontally between said cells and fluid-tightly segregating said cells from one another, means for feeding an electrolyte to each of the cells and for removing products of electrolysis from said cells, said separator and collector means comprising a current collector for feeding electric current to anode plates of both of said stacked cells, lower ends of anode plates of said upper cell and upper ends of anode plates of said lower cell being connected to said current collector, and means for connecting said current collector to an electric current supply means.

2. Electrolytic apparatus according to claim 1, wherein the current collector comprises a metal sheet which has its two faces secured respectively to anodes of the two cells.

3. Electrolytic apparatus according to claim 2 wherein the current collector is made of a metal that is resistant to corrosion by the electrolyte and the products of electrolysis, and constitutes the upper surface of a composite wall that is common to both of said cells.

4. Electrolytic apparatus according to claim 3, wherein the current collector is made of titanium.

5. Electrolytic apparatus according to claim 1, wherein the current collector comprises a series of parallel metal bars extending respectively between the anode plates of the two cells and secured between the said anode plates.

6. Electrolytic apparatus according to claim 5, wherein the anode plates of one cell form extensions of the anode plates of the other cell.

7. Electrolytic apparatus according to claim 1 wherein the current collector is immersed in a mass of thermally and electrically non-conducting material which forms part of a common wall of the two cells.

8. Electrolytic apparatus according to claim 1, wherein the cells are for the electrolysis of a solution of alkali metal chloride.

9. Electrolytic apparatus according to claim 1, wherein the current collector extends horizontally between stacked cells and wherein the lower cell comprises a metal casing closed at its lower end by a steel baseplate, said casing supporting a corrugated metal screen cathode, which is covered with a diaphragm facing the anodes of the lower cell and which delimits substantially vertical cathode pockets between the said anodes and a substantially horizontal compartment in communication with the said pockets beneath the said anodes.

10. Electrolytic apparatus according to claim 1, wherein said separator and collector means comprises a cover for said lower cell and a base of said upper cell, said current collector being interposed between said cover and base.

11. Electrolytic apparatus according to claim 10, wherein at least one of said cover and said base is provided with grooves on the side facing the current collector to provide ventilation of the current collector.

12. Electrolytic apparatus according to claim 1, wherein said current collector comprises partition means segregating said superposed cells from one another.

13. Electrolytic apparatus according to claim 1, wherein the current collector is made of a metal that is resistant to corrosion by the electrolyte and to the products of electrolysis, and constitutes the lower surface of a composite wall that is common to both of said superposed cells.

14. Electrolytic apparatus according to claim 13, wherein the current collector is made of titanium.

15. Electrolytic apparatus comprising three vertically stacked but separate monopolar electrolytic cells namely a lower cell, an intermediate cell and an upper cell, each of said cells comprising side walls, generally vertical and parallel spaced cathodes supported by said side walls and generally vertical and parallel anode plates alternating with said cathodes, first separator and collector means disposed generally horizontally between said upper and intermediate cells and fluid-tightly segregating said cells from one another, second separator and collector means disposed generally horizontally between said intermediate and lower cells and fluid-tightly segregating said cells from one another, means for feeding electrolyte to each of the cells and for removing products of electrolysis from said cells, said first separator and collector means comprising a first current collector for feeding electric current to anode plates of said upper and intermediate cells, the lower ends of anode plates of said upper cell and upper ends of anode plates of said intermediate cell being connected to said first current collector, and said second separator and collector means comprising a second current collector for feeding electric current to anode plates of said intermediate and lower cells, the lower ends of anode plates of said intermediate cell and upper ends of anode plates of said lower cell being connected to said second current collector, and means for connecting said first current collector and said second current collector to an electric current supply means.

16. Electrolytic apparatus according to claim 15, wherein each anode of the intermediate cell comprises two plates placed vertically in alignment one above the other, the upper plate being connected to said first current collector and the lower plate being connected to said second current collector, the said two current collectors being connected in parallel to a bus bar so as to form with said bus bar a common current collector for anodes of the three cells.

* * * * *